US005463920A

United States Patent [19]

Korb

[11] Patent Number: 5,463,920

[45] Date of Patent: Nov. 7, 1995

[54] NOTCH CUTTER AND METHOD

[76] Inventor: Lothar Korb, 22 Burningham Cr., Ajax, Ontario, Canada, L1S 6A2

[21] Appl. No.: 172,173

[22] Filed: Dec. 23, 1993

[51] Int. Cl.[6] ..... B26D 1/09; B26D 3/14

[52] U.S. Cl. ..... 83/56; 83/636; 83/693; 83/699.31; 83/699.51; 83/917; 83/937

[58] Field of Search ..... 83/636, 635, 646, 83/639.1, 620, 692, 693, 917, 936, 937, 699.31, 699.51, 56; 144/216, 217

[56] References Cited

U.S. PATENT DOCUMENTS

| | | | |
|---|---|---|---|
| 422,517 | 3/1890 | Fox | 144/217 X |
| 1,139,572 | 5/1915 | Perry | 83/636 X |
| 3,213,741 | 10/1965 | Harding | 83/693 X |
| 3,215,017 | 11/1965 | Rutz | 83/693 X |
| 3,277,763 | 10/1966 | Haug | 83/693 X |
| 4,124,937 | 11/1978 | Gaughf, Jr. | 83/693 X |
| 4,129,054 | 12/1978 | Fazis | 83/693 X |
| 4,483,227 | 11/1984 | Camisa | 83/693 X |
| 4,558,619 | 12/1985 | Caumont | 83/699.31 X |
| 4,831,910 | 5/1989 | Poulsen | 83/693 |
| 5,295,424 | 3/1994 | Aulicky | 83/693 X |

*Primary Examiner*—Rinaldi I. Rada
*Assistant Examiner*—Clark F. Dexter
*Attorney, Agent, or Firm*—Robert L. Westell

[57] ABSTRACT

A fabric notch cutter includes a pair of inwardly facing shear edges which converge to a first apex and a pair of outwardly facing shear edges which converge to a second apex at a slightly lesser angle than the convergence angle of the inwardly facing shear edges. Each of the outwardly facing shear edges contacts a respective one of the inwardly facing shear edges at a contact point. Further, the outwardly facing shear edges are resiliently mounted such that they are retracted toward their support member during a cutting operation. The points of contact between the shear edges progress toward the apices during the cutting operation.

19 Claims, 6 Drawing Sheets

FIG. 8.
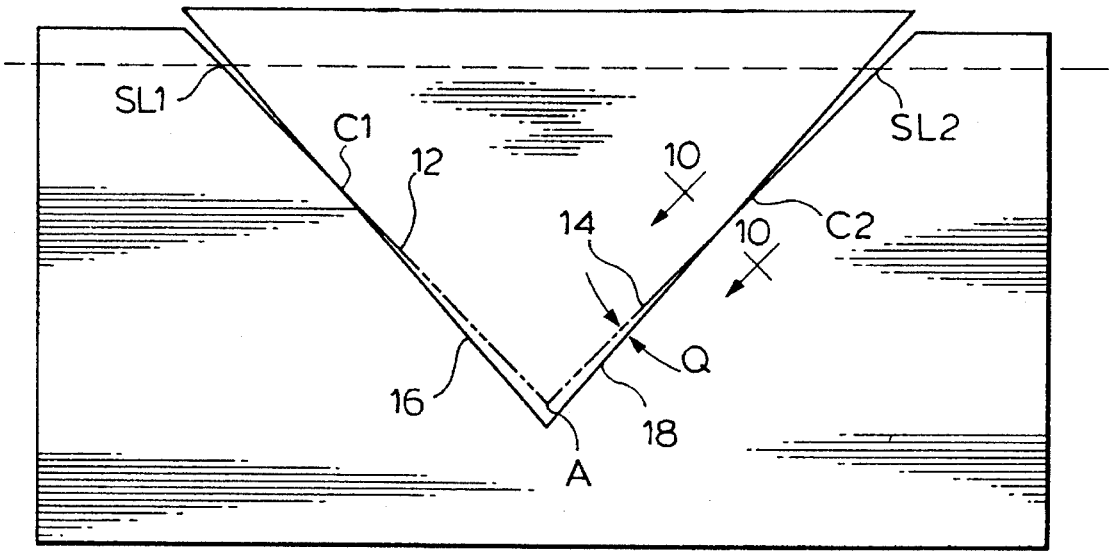
FIG. 9.
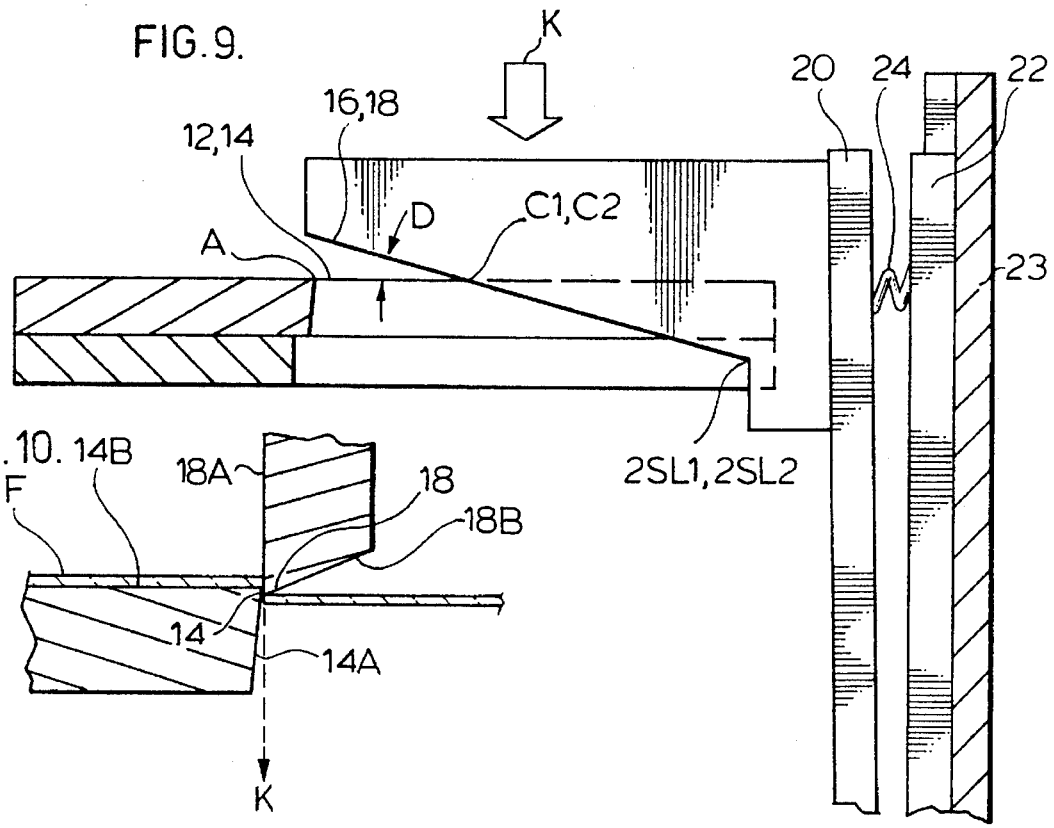
FIG. 10.

NOTCH CUTTER AND METHOD

BACKGROUND OF THE INVENTION

This invention relates to a cutter for cutting tapering notches in the edge of a fabric.

Notches can be required in a fabric edge for many reasons, such as for folding the outer strips of mattress covers at the corners, for producing gussets or pleats or for many other purposes. Also as the application later shows, a notch may be made in one fold of a doubled fabric to produce an aperture in the fabric.

SUMMARY OF THE INVENTION

The notches cut by the apparatus of this invention are those which commence at two spaced points or 'start locations' at the edge of the fabric (or a fold acting as an edge) and continuously converge to an apex at a point inward on the fabric from the edge.

Although in the preferred embodiment, the notch has two straight edges converging at 90° to each other, other convergence angles may be used, the notch need not be symetrical and the edges of the notch need not be straight.

In accord with the invention a first, usually stationary member, provides a pair of inwardly facing shear edges defining the notch and continuously converging from two spaced start locations corresponding to the mouth, i.e. entrance of the notch to a point forming the apex of the notch.

A line is defined for the location of the fabric edge (or fold acting as an edge) and includes said spaced start locations.

A second pair of shear edges is provided having resilient mounting means as defined hereafter. The second pair of edges is mounted to move relative to the first pair in a cutting direction to perform the cutting action. The second pair of edges are outwardly facing and, when viewed in the cutting direction, converge to an apex as do the first pair of edges; but the second pair of edges have a slightly smaller angle of convergence. Thus where, in the preferred embodiment, the angle of convergence viewed in the cutting direction is 90° for the first pair of shear edges, the angle of convergence for the second pair of edges is 89° 30' so viewed.

The second pair of shear edges is so mounted relative to the first, that with a fabric edge lying along the line of the two spaced start locations and with the body of the fabric overlying the apex, these second shear edges may be located or advanced to make point contact with the respective first shear edges at the two spaced start locations. What is refered to as a 'point contact' herein is realistically a very short line contact. An actual point contact would be a practical impossibility and, could it be achieved, would cause contacting shear edges to gouge each other. As the line increases in length, pressure between the contacting shear edges decreases until it is insufficient to cut the fabric. Thus the 'point contact' herein is a very short line contact. As movement in the cutting direction is continued the contact points move gradually toward the first shear edge apex until the apex is reached. The movement of the second edges is permitted by their resilient mounting which allows movement of the second shear edges toward their support in a direction generally corresponding to that from apex to fabric edge. As the second shear edges are progressively moved relative to the first in the advance direction, the fabric is progressively cut at the point contacts from the two start locations toward the apex, the point contact being maintained between the interacting shear edges as they move toward the apex. This point contact tends to create a clean cut of every fibre in the fabric.

The preferred resilient mounting for the second pair of shear edges has two main functions. Firstly it allows, during movement of the edge pair in the cutting direction, sufficient deflection to allow retraction of the second pair of shear edges, consequent on the movement of the contact points from the start locations to the apex. Secondly it allows limited tilting between the second edge pair and its support to compensate for minor misalignment of the edge set geometry. The preferred resilient mounting comprises a pair of compression springs which bias the second edge pair toward the apex. During the cutting operation the springs are adapted to provide enough pressure at the contact points to cut the fabric and the spring pressure tends to maintain the sharpness of the contacting shear edges due to a slight abrasion of the contacting edges during each stroke.

Preferably the resilient mounting for one pair of (preferably the second shear) edges comprises a direct mounting member. The mounting member is preferably biased by compression springs toward the apex at a location laterally displaced from the first shear edges when viewed in the line joining the start positions. It is noted that the movement permitted by these compression springs must be sufficient to accommodate the lateral movement of the second pair of shear edges during the cutting stroke. At a location displaced from the first shear edges in the cutting direction the mounting member is biased by a compression spring relative to the support member in a direction away from the apex.

The combination of the resilient biasing toward the apex and the displaced biasing away causes the mounting member to act somewhat like a member pivoted at the displaced location to move about on an axis roughly parallel to the line joining the start locations. It further imparts a slight angle to the defining side of the second shear edges assisting in creating point contact with the first shear edges. The biasing means preferably allow slight movement in directions lateral with respect to their biasing direction. They also allow slight tilting of the mount about axes transverse relative to the cutting direction. This allows the resiliently mounted knife a small leeway for self adjustment in the event the two pairs of edge members are misaligned and tends to provide equal pressure at the contact points.

BRIEF DESCRIPTION OF THE DRAWING

In drawings which illustrate an embodiment of the invention:

FIG. 8 shows in plan the relationship of the two knife members at an intermediate stage of the stroke, FIG. 9 shows a side view of the two knife members at an intermediate stage of the stroke.

FIG. 10 is a view along the lines 10—10 of FIG. 8,

DETAILED DESCRIPTION OF THE PREFERRED EMBODIMENT

Figure 2A:
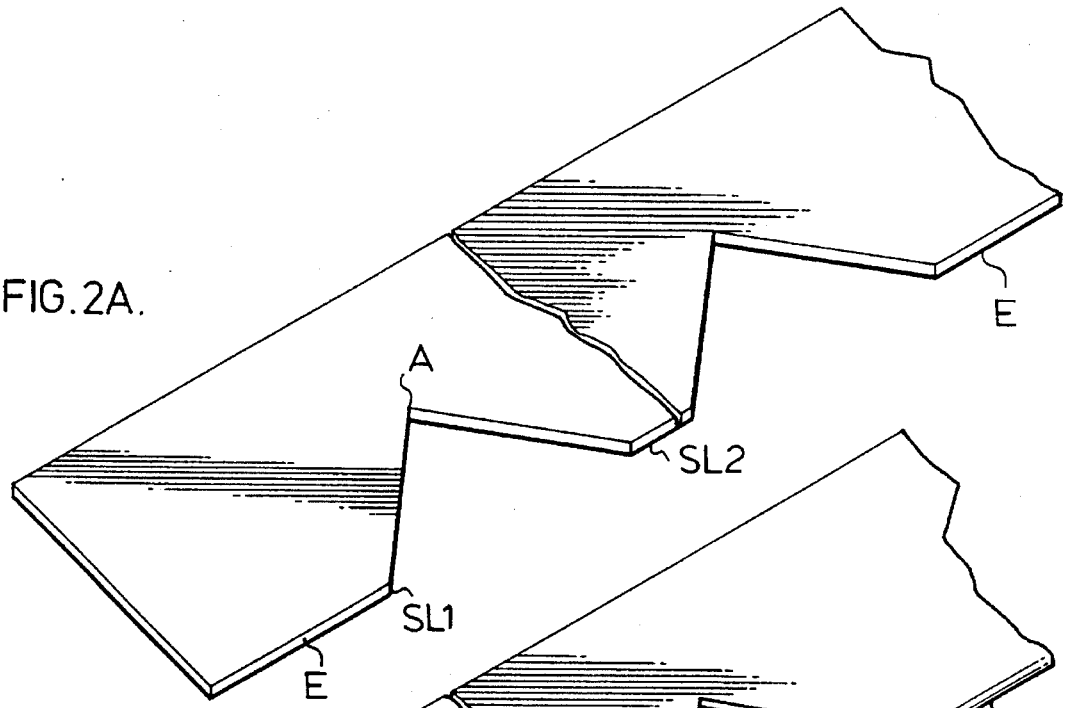

In drawings, FIG. 2A shows a notched fabric where the notch edges continuously converge at 90° from spaced start locations SL1, SL2 at the fabric edge E to apex A inwardly of the edge.

Figure 2B:
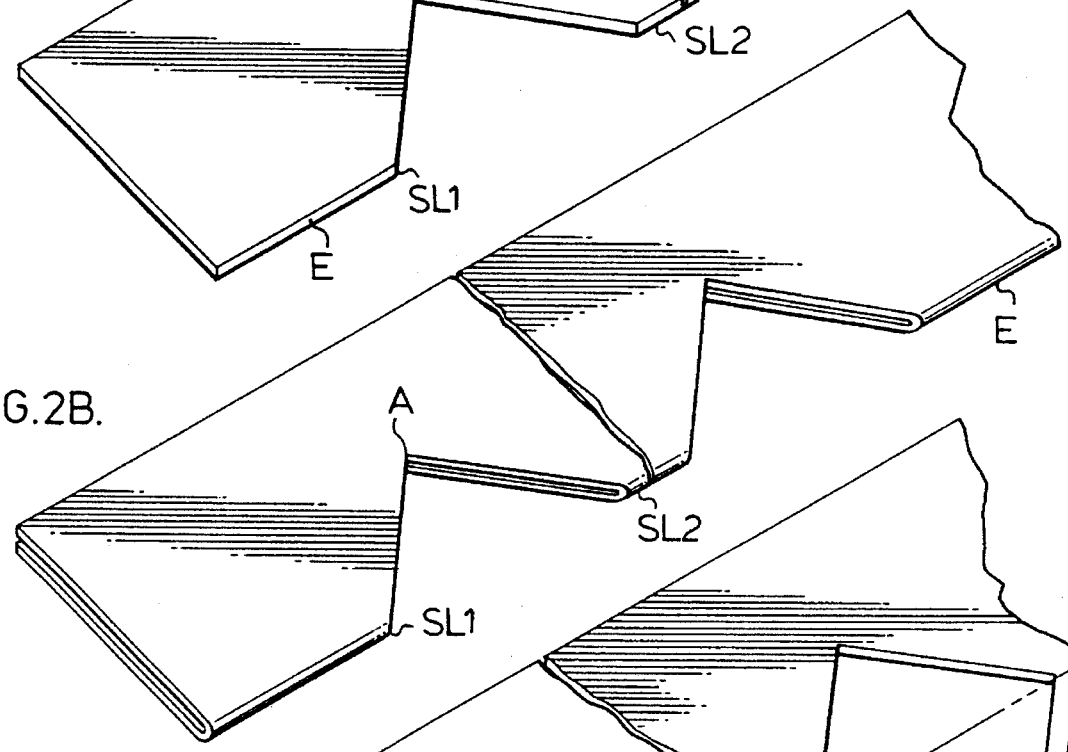
Figure 2C:
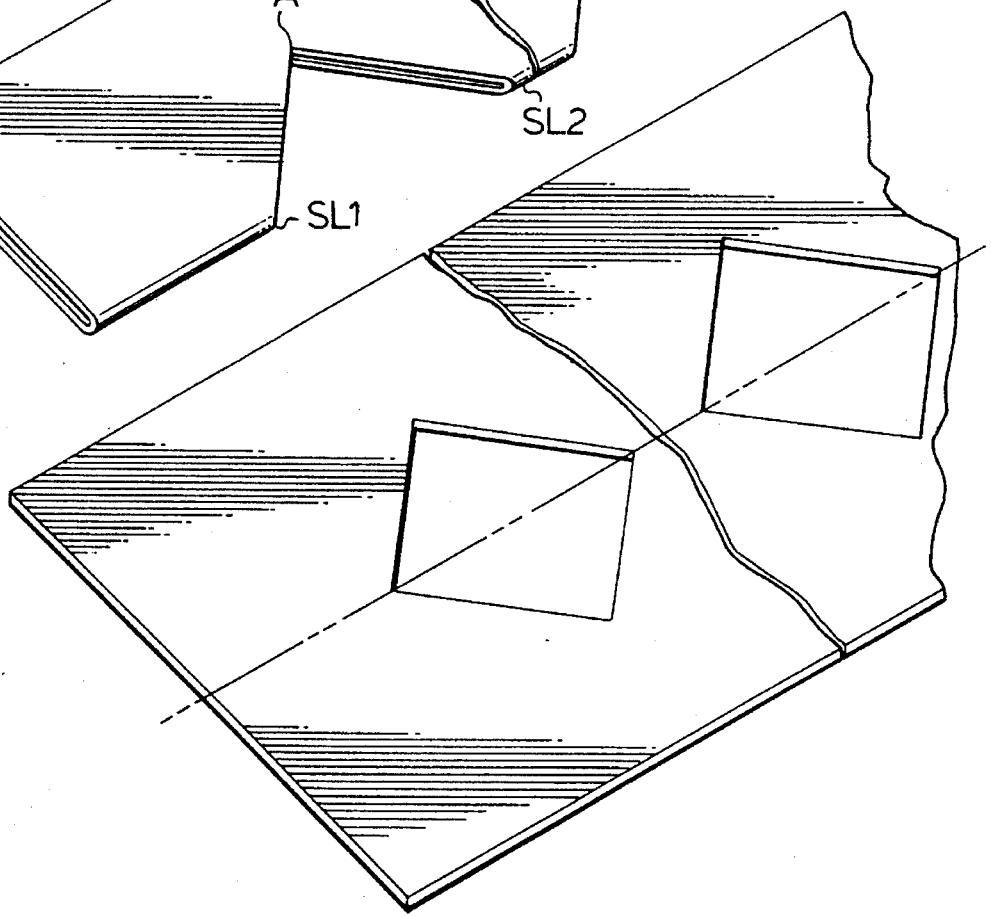

FIG. 2B shows a folded fabric notched at the fold line to produce square apertures (FIGS. 2C) when the fabric is unfolded.

The fabric, which is notched along an edge, may be several feet or yards wide.

Figure 1:
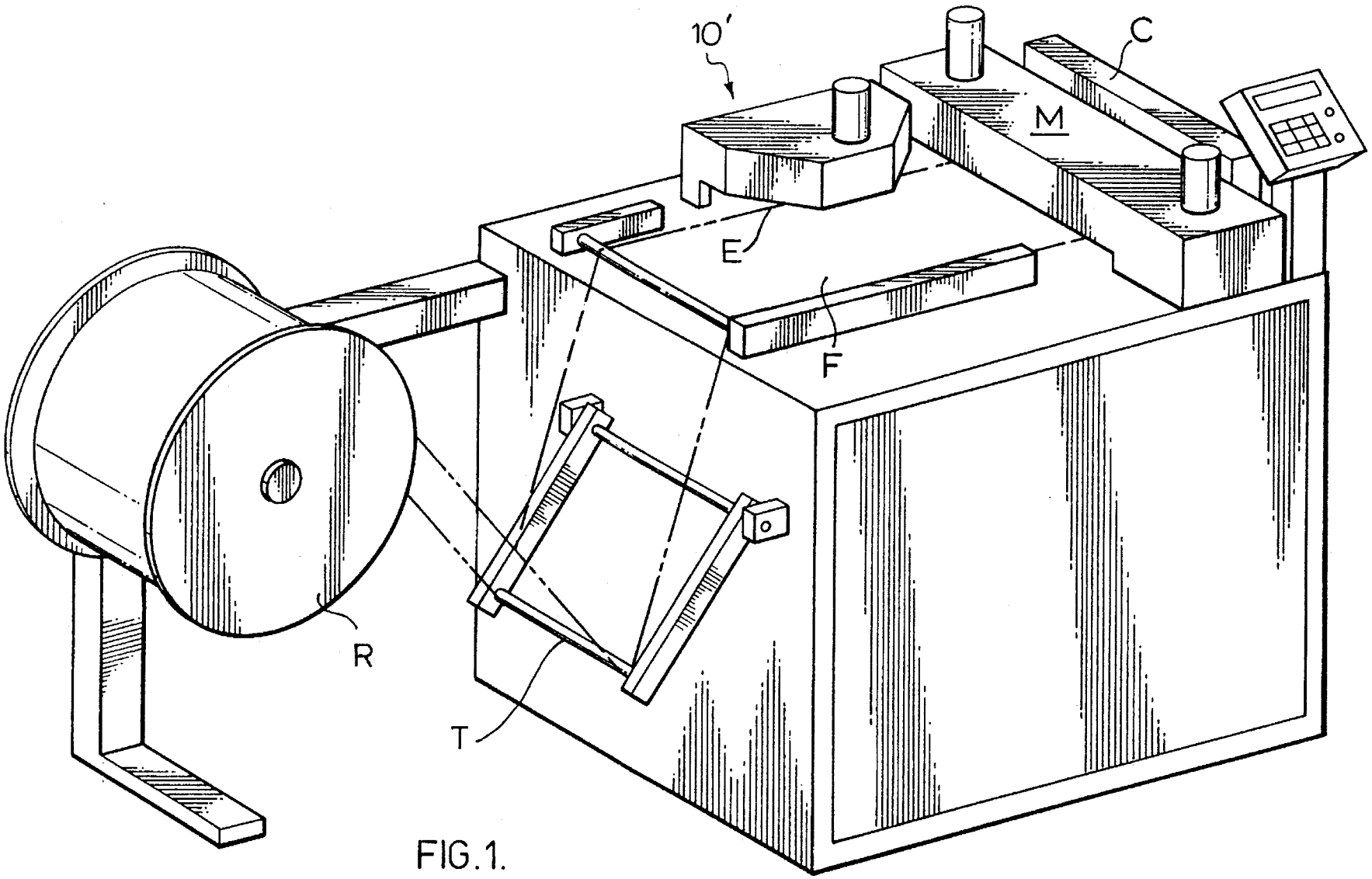
FIG. 1 is a perspective view showing the environment for the fabric and the fabric cutter, FIGS. 2A, 2B and 2C demonstrate the appearance of two exemplary forms of fabric notch.

FIG. 1 is a schematic view showing the path, in chain dots of a typical fabric F path from a supply roll R across a table by a measuring machine M to a guillotine cutter, C, where edge E will be notched by the apparatus 10' to be described in detail. Except for the apparatus 10' the equipment shown is conventional. This the supply roller and take up bar T will have biasing and tensioning (not shown) located in the measuring machine which togther will maintain the fabric stationary and positioned during the notch cutting operation. Other conventional means for so maintaining the fabric position may of course be used.

FIGS. 3 to 10 demonstrate schematically the working of the invention. A first knife mounted on support 11 comprises the body 10 defining inwardly facing shear edges 12 and 14 open to one edge of the body and continuously converging from spaced start locations SL1 and SL2 to an apex A. Thus the line SL1– SL2 coincides with the entrance to the notch. As demonstrated by FIG. 10 the knife edge 14 is defined by surface 14B, perpendicular to direction K and surface 14A at an angle of two degrees (2°) to direction K. Knife edge 12 is similar. A second knife is carried by a moving support to advance in a cutting direction K to perform the notching action. The second knife comprises the edges 16, 18. As demonstrated by FIG. 10 the knife edge 18 is defined by surface 18A, parallel to direction K and surface 18B at an angle 120° to direction K. The knife edge 16 is similar.

Figure 6:
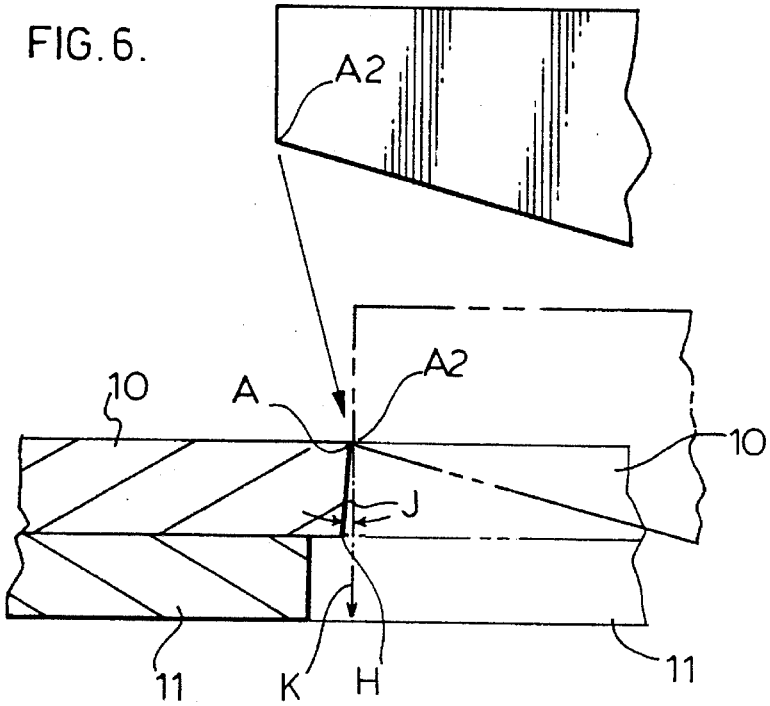
FIG. 6 is a section view showing the lateral retraction of the second pair of edge members during the advance stroke.

As best shown in FIG. 6 the line downward from apex A defining the continuation of the apex groove makes an angle J of about 2° (exaggerated in the drawing) to direction K. It will be noted however from such Figures as FIGS. 4 and 8, that contacting edges 12 and 16 or 14 and 18 are not parallel but at a small angle to each other. Thus the contacting edges meet at a very short line known herein as a 'contact point', rather than a extended line and such point contact is considered very important to a clean (cutting every fibre) cutting of the fabric.

The first pair of shear edges 12 and 14 defines a median plane substantially perpendicular to the cutting direction K. (It is noted that edges which are not straight, nor within a single plane, which are within the scope of the invention, may be considered to define a median (i.e. an approximate or average) plane for the purposes of discussion herein.)

The second shear edges 16 and 18 may also be considered as defining a median plane.

The second shear edge median plane diverges at angle D at about 20° to the other median plane toward the apex from the line joining points SL1 and SL2, as viewed along that line.

Figure 3:
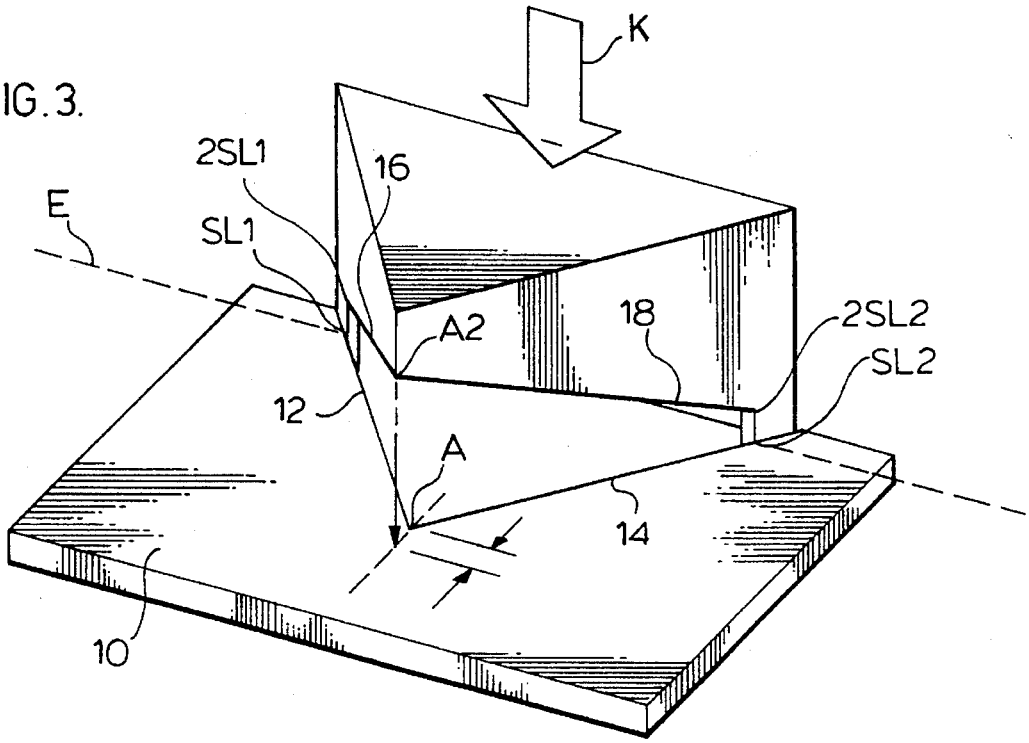
FIG. 3 shows schematically and in perspective the relation of the first and second pairs of edges.
Figure 4:
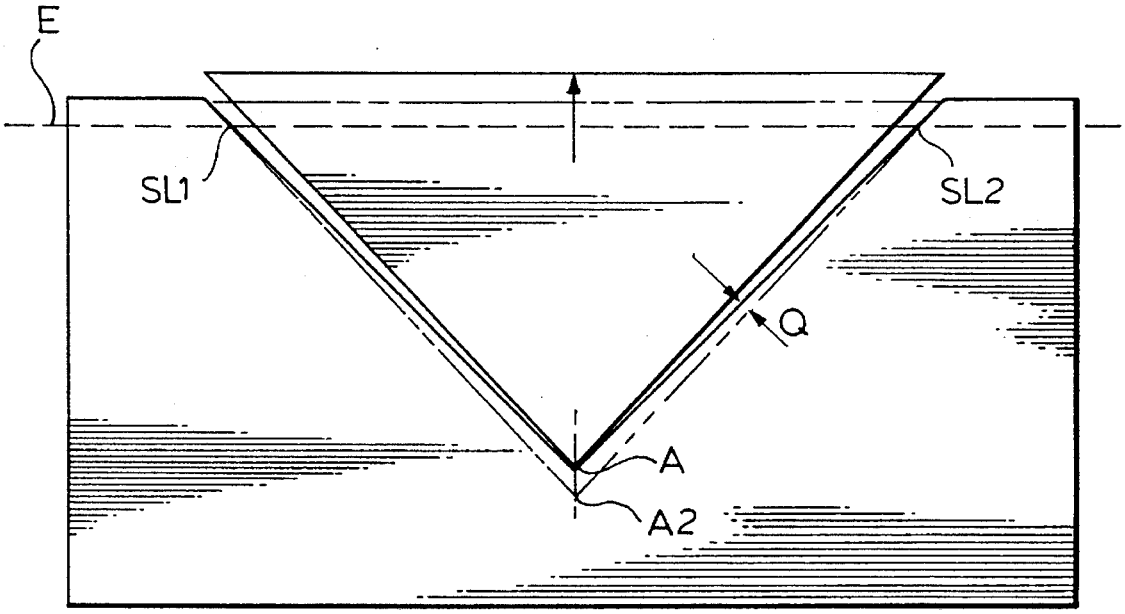
FIG. 4 shows in schematically and in perspective the contact points of the edge members.

The second shear edges are therefore dimensioned and located on advance movement from retracted position FIG. 3., to a start position, where points 2SL1 and 2SL2, initially contact the first shear edges at SL1 and SL2 respectively. (These points initially coincide with the fabric edge line E and at coincidence define the entrance to the notch, and the two pairs of shear edges are arranged so that sets consisting of an edge from each pair will make point contact in the absence of fabric, and on continued advance with fabric in place will sever the fabric at the contact point of the set.)

As the advance movement of the second (upper) pair of shear edges 16 and 18 progressively continues the contact points C1, C2 progressively move inwardly along the first shear edges 12 and 14 toward the apex. This progressive movement of the points C1, C2 causes and requires the movement of the second shear edges 16 and 18 in a direction away from the apex A (see FIGS. 6 and 8). This is accommodated by providing that the second shear edges are rigidly mounted on a backing member 20 which in turn is resiliently mounted on support member 22. The support member 22 therefore travels in the cutting direction K usually perpendicular to the median plane of the first shear edges 12 and 14 while the backing member 20, with the second shear edges, superimposes on such advance direction the retractive movement which is permitted by the resilient mounting, now to be described. The cutting direction movement, now being described, is continued until the apices A and A2 of the first and second pair of shear edges coincide, (that is until contact points C1 and C2 have reached apex A); at which point, the notch has been cut in the fabric edge and the material from the notch may be discarded.

Detailed construction of the second shear edges and their support will now be described. The second "knife" is shaped when viewed in the cutting direction to define a second knife body almost complementary (viewed in such direction) to the first pair of shear edges but converging at 89° 30' rather than 90°. A second shear edge contacts a first shear edge therefore at an angle of 15'. The bodies on which the edges 12, 14, 16 and 18 are formed are preferably a hardened tool steel having the discussed shape, in plan, and defining the jaw edges. Walls defined on the intersection of its side and (sloping) lower surface contours define the second shear edges 16 and 18. The contours of edges 16 and 18 are such as to diverge at an approximately 20° (angle D) from the first shear edges when viewed along line SL1–SL2. This slope is from points 2SL1 and 2SL2 spaced to coincide with SL1 and SL2 upwardly toward the apex A2. It will be noted that the slope of 20° is measured viewing in the direction of the line 2SL1–2SL2. The second knife body as shown is rigidly supported on backing member 20 which extends longitudinally approximately parallel to direction K. The backing member is resiliently supported on support 22 and in rest attitude is at a slight downwardly converging angle thereto. The resilient support means for shear edges 16 and 18 comprises upper and lower sets of spring members. In the preferred embodiment the upper set comprises a pair of compression springs 24 each bearing outwardly on the backing member 20 and the support 22 to bias them to a spaced relationship. It is noted that such spacing must be greater than the spacing in plan of the apices A and A2, in the upper start position of the latter (see FIG. 4) to allow for retraction of the shear edge members 16 and 18 relative to edges 12 and 14 when apices A and 2A move toward coincidence at the extended position.

The lower set of springs preferably comprises a single spring 25 which is associated with shank 29 mounted on backing member and slidably extending through aperture 27 in support 22 to a stop 26. The compression spring bears on the stop 26 and the support 22 to bias the backing member 20 toward the support 22. The effect of the opposed biasing at the upper and lower spring sets, in the relaxed position (before the advance stroke) slightly decreases the aforementioned angle below 20° in rest attitude and the angle will vary slightly during movement in the cutting direction.

The mounting for single spring 25 (or mountings for a plurality of such springs, if provided) is designed to allow small lateral as well as longitudinal movement of backing member 20 relative to support 22. Such mounting or mountings will also allow a small angle of tilt in any azimuth angle about the spring axis relative to support 22. Such flexibility of the mount includes in the specific embodiment a loose fit for shank 29 in aperture 27 of backing member 20, support 22.

The mounting for springs 24 near the upper end of the backing member 20 and support 22 also allows for small movement of the backing member 20 longitudinally and laterally and to tilt through a small angle in any azimuth angle about the axis of the spring.

It should also be noted that the opposite biasing of the upper and lower sets of springs tends to provide a quasi pivotal effect at the lower spring 25 since because of the nature of their biasing, many angular changes between backing member 20 and support 22 take place about an approximately horizontal axis near spring 25.

The small angle Q (see FIG. 4 and 8) is measured, looking along cutting direction K, between edges 12 and 16 and also between edges 14 and 18. The angle is preferably about 15' (15 minutes). It must be great enough, given the strength of springs 24 to make the point contact near enough to the ideal, to cut every fibre in the fabric and small enough to avoid gouging of the edges. The intersection of edge sets 12 and 16 makes point contact C1 and the intersection of edge sets 14 and 18 makes point contact C2.

It will be noted that the resilient biasing used allows for slight differential compression at the springs of the upper set and for slight lateral movement or tilting of the frame 20 relative to the support 22. These allowed activities permit a self centering action during the advance stroke since, in the event of a slight misalignment for any reason, one contact point (say C1) advances closer to the apex A than C2, the forces at C1 and C2 on the second pair of shear edges 16 and 18 tend to move the second pair of edges so that C2 equalizes with C1.

Support 22 is adapted to reciprocate between the rest and advanced position in the cutting and opposite direction. (Rest position is that shown in FIG. 3). Retract position is the point when the advance movement has brought points 2SL1 and 2SL2, respectively into contact with points SL1 and SL2. Advance position is where A contacts A2 and the contact points C1, C2 have, with the advance stroke, progressively moved from SL1 to A and SL2 to A, respectively. FIG. 8 is a view of the points C1, C2 respectively intermediate points SL1 and A, and SL2 and A. FIG. 9 is a side view showing the point C1 at a location intermediate SL1 and A.

Figure 5:
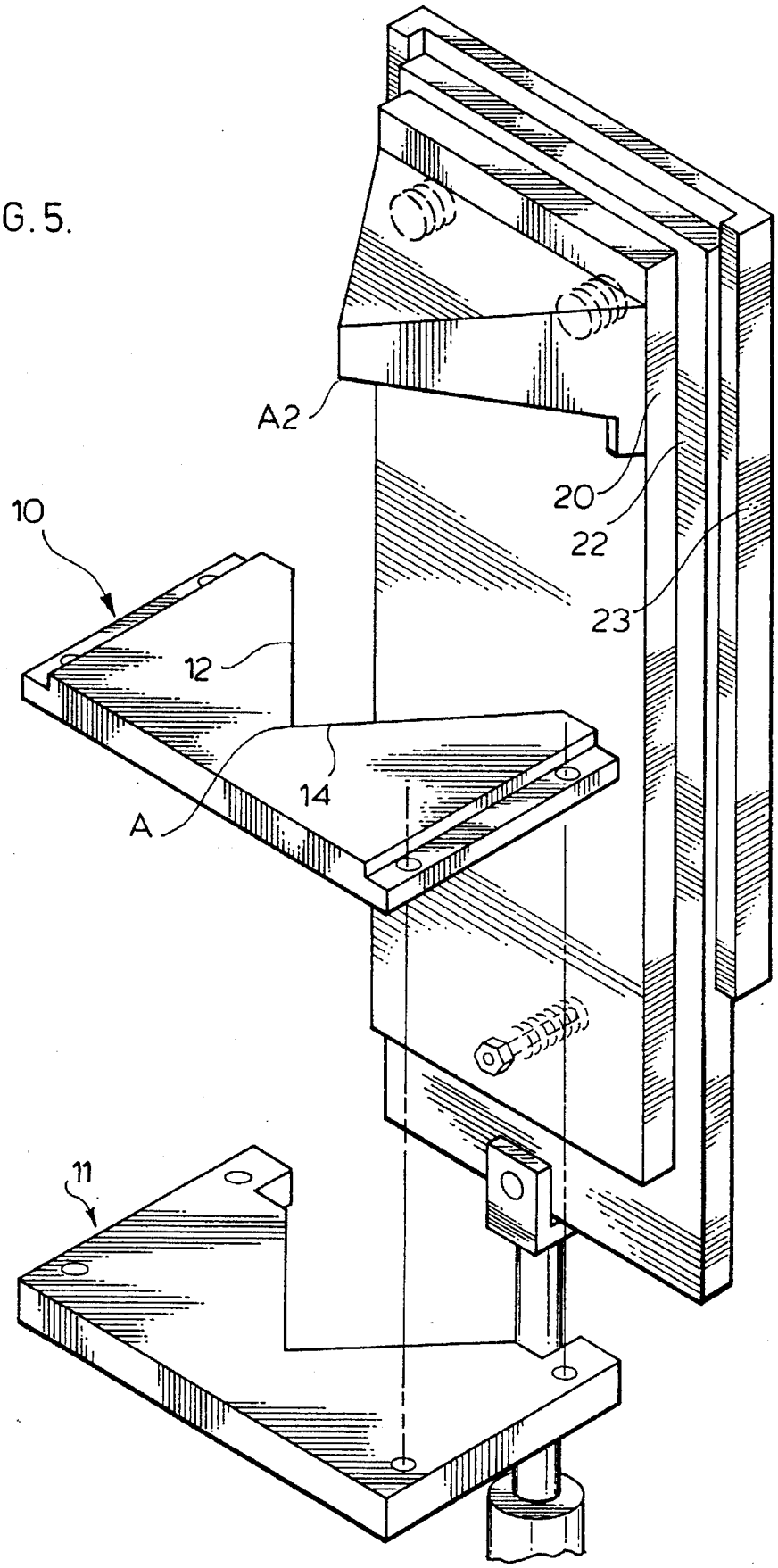
FIG. 5 is an exploded perspective view to the knife members and their supports.
Figure 7:
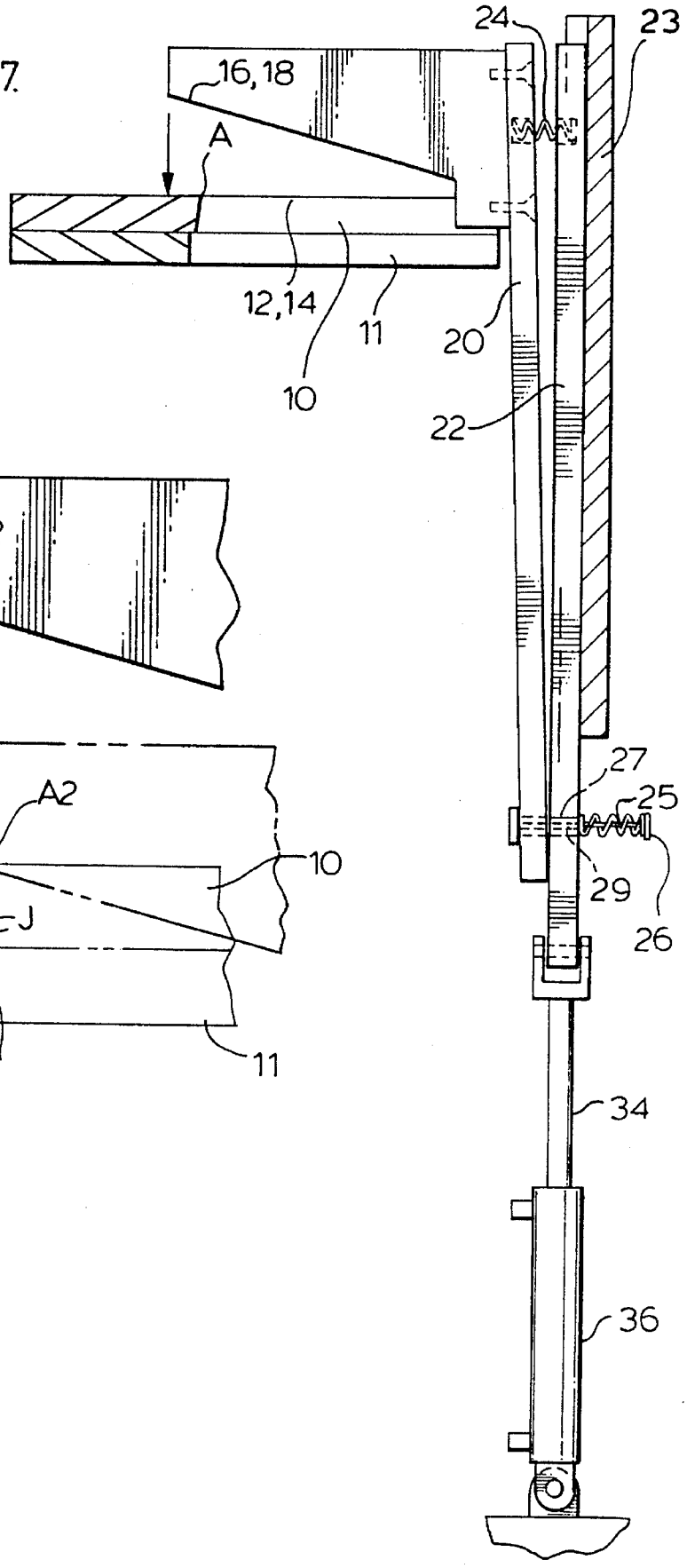
FIG. 7 is a vertical section of the edge members.

Support 22 is driven and guided to move in direction K in any desired manner. For example FIG. 5 shows support member 22 moving in the (schematic) guideways of guide member 23 to move in direction K. The drive to move support 22 between retracted and extended position may be provided by piston rod 34 activated by piston 36. The outside mountings on a suitable base for guide member 23 and for piston 36 are not shown.

It is believed that the operation of the device will be obvious from the foregoing description but it will be synopsized here. Initially the fabric is in place, with the fabric edge E lying along the line SL1–SL2, and the rest position of the upper and lower knife members is as shown in FIG. 3. The shear edges 16 and 18 of the second knife are above and, looking in direction K' just outward of the points SL1 and SL2.

The second knife is advanced toward the first in direction K so that point 2SL1 contacts point SL1, temporarily defining moving contact point C1 and 2SL2 contacts point SL2 temporarily defining moving contact point C2.

As movement of the second knife in the advance direction progressively continues, contact points C1, C2 move along edges 12, 14 toward apex A. FIGS. 8 and 9 show C1, C2 at an intermediate position between SL1, SL2, respectively and A. During such progressive movement the reaction of edges 12, 14 on, respectively, edges 16, 18 retracts edges 16, 18 and backing member 20 against the bias of springs 24.

Meanwhile the fabric has been progressively cut inward from the edge at the points C1, C2.

As the advance stroke is completed the points C1, C2 have moved to coincidence at point A and the cut is complete. The path of A2 toward A during the advance stroke is shown in FIG. 6.

After completion of the advance stroke, in accord with means conventional, but not shown, the notch material is removed, the second knife is moved to the retracted position, and the fabric is moved away from the supply roller (or cut and then so moved) so that a new swatch of fabric is positioned to be cut in the cycle.

It is noted that with the folded fabric of FIGS. 2 and 3 (with the fold line defining the edge E) a square of fabric is removed to provide an aperture of the shape of the notch plus its mirror image.

Discussions of parameters follow.

The angle Q measured looking in cutting direction K between each set of interacting shear edges is preferably between 0° 5' and 0° 30' and 0° 15' is thought best. It is difficult to set upper and lower limits for such angle. The angle will vary for the type of fabric being cut, the material of the shear edges and the amount of variation in the geometry of the knives. However too small an angle risks converting the point contact between the edges into a line contact which may cause incomplete fibre cutting or jamming of the knives. It must also be noted that this effect may occur at one only pair of interacting shear edges since the resilient mounting allows slight skewing of the second shear edges under some reactive stresses. The upper limit for the differential angle (looking in direction K) between interacting shear edges is controlled inter alia by the fact that, with increase of differential angle the retraction stroke permitted by the resilient mounting must be increased and this is both inconvenient and will allow too much leeway for twisting and torsion of the second knife. Moreover a large differential angle tends to cause chipping of interacting edges and it must be remembered that the differential angle may increase at one set of interacting edges and decrease at the other because of the skewing permitted at the differential mounting.

It is further difficult to set limits for the differential angle D between the upper and lower edges as measured in a view along line SL1–SL2 (FIG. 9). If this angle is too great the vertical stroke required of the equipment is too large for convenience and further the chance of chipping at the edges is increased. If the angle is too small the risk of changing point contact into line contact is increased it is noted that this possibility is increased, and by the tilting allowed by the resilient mount.

I claim:

1. Fabric notch cutter comprising:

a pair of inwardly facing shear edges defining a first median plane and continuously converging in a first direction to define a first entrance and a first apex when viewed transversely to said plane, a pair of outwardly facing shear edges defining a second median plane and converging to a second apex at a slightly lesser angle than the inwardly facing edges, said second median plane sloping away from said first median plane in said first direction, means for bringing each of said outwardly facing shear edges into contact with a respective one of said inwardly facing shear edges at a respective contact point and for moving said pairs of shear edges relative to each other to cause said contact points to continuously progress toward said apices until said first and second apices contact each other, and means for supporting the pair of outwardly facing shear edges to support movement of said outwardly facing shear edges in a second direction opposite said first direction during said relative movement of said pairs of shear edges and for resiliently biasing said outwardly facing shear edges toward said inwardly facing shear edges.

2. Fabric notch cutter for cutting a notch defining an entrance width in said notch, comprising:

a pair of inwardly facing shear edges defining a first median plane and converging in a first direction from two first points spaced at a predetermined distance, which is substantially equal to said entrance width, to a first apex, a pair of outwardly facing shear edges defining a second median plane and converging from two second points, which are spaced substantially at said predetermined distance, to a second apex at a slightly lesser convergence angle than the inwardly facing edges, wherein there is a difference in said convergence angles, said inwardly facing shear edges and said outwardly facing shear edges being oriented with respect to one another such that said second median plane slopes away from said first median plane in said first direction, shear moving means for moving said pair of outwardly facing shear edges in a relative cutting direction into contact with said pair of said inwardly facing shear edges so that each of said outwardly facing shear edges contacts a respective one of said inwardly facing shear edges to provide contact points initially spaced at said predetermined width, said shear moving means further continuing said relative moving in said cutting direction causing said contact points to progress toward said apices until said apices coincide, and support means for supporting the pair of outwardly facing shear edges for movement of said outwardly facing shear edges in a second direction opposite said first direction and for resiliently biasing said outwardly facing shear edges toward said inwardly facing shear edges in said first direction during said relative moving to a relative position where said apices coincide, whereby said contact points, during said relative moving, progress to meet substantially at said coincident apices.

3. Fabric notch cutter as claimed in claim 2 wherein said support means supports said pair of outwardly facing shear edges for limited relative lateral movement from side to side relative to said pair of inwardly facing shear edges and provides limited resilient relative tilting of said second median plane relative to the first median plane during said movement of said outwardly facing shear edges in said second direction.

4. Fabric notch cutter as claimed in claim 3, wherein the difference in convergence angles is between 0° 10' and 1° 0".

5. Fabric notch cutter as claimed in claim 3 wherein the difference of convergence angles is about 0° 30'.

6. Fabric notch cutter as claimed in claim 2, wherein the difference in convergence angles is between 0° 10' and 1° 0".

7. Fabric notch cutter as claimed in claim 2 wherein the difference of convergence angles is about 0° 30'.

8. Fabric notch cutter as claimed in claim 2 wherein said support means includes a support on which said outwardly facing shear edges are resiliently supported.

9. Fabric notch cutter as claimed in claim 8 wherein the difference in convergence angle is between 0° 10' and 1° 0".

10. Fabric notch cutter as claimed in claim 2 wherein said support means comprises means resiliently biassing said outwardly facing shear edges in said first direction, said means for resiliently biassing maintaining said pairs of shear edges in contact during said movement in said cutting direction, and wherein said support means supports said pair of outwardly facing shear edges for limited relative lateral movement from side to side relative to said inwardly facing shear edges, and provides limited resilient tilting relative to said inwardly facing shear edges.

11. Fabric notch cutter as claimed in claim 10 wherein the difference in convergence angle is between 0° 10' and 1° 0".

12. Fabric notch cutter as claimed in claim 2 wherein said support means includes a backing member mounted to a support member, and wherein said pair of outwardly facing shear edges are fixedly mounted on said backing member which is spring biassed by first spring biassing means away from said support member in said first direction and spring biassed by second spring biassing means toward said support member in said second direction.

13. Fabric notch cutter as claimed in claim 12 wherein said first and second spring biassing means support said backing member and said outwardly facing shear edges for limited relative lateral movement from side to side with respect to said inwardly facing shear edges and provide limited tilting movement of said backing member and said outwardly facing shear edges with respect to said support member.

14. Fabric notch cutter as claimed in claim 13 wherein the difference in convergence angle is between 0° 10' and 1° 0".

15. Fabric notch cutter as claimed in claim 12 wherein the difference in convergence angle is between 0° 10' and 1° 0".

16. Method of cutting a notch in a fabric edge comprising the steps of:

providing a pair of inwardly facing shear edges defining a first median plane, wherein the shear edges continuously converge in a first direction at an angle to define a first entrance and a first apex, providing a pair of outwardly facing shear edges defining a second median plane, wherein the outwardly facing shear edges converge to a second apex at a slightly lesser angle than said first angle, wherein there is a difference in said convergence angles, orienting said pairs of shear edges such that said second median plane slopes away from said first median plane in said first direction, causing said outwardly facing shear edges to each establish shearing contact points with a respective one of said inwardly facing shear edges initially at contact point locations spaced from said apices, whereby initially said second apex is displaced from said first apex in said first direction, progressively moving said outwardly facing shear edges relative to said inwardly facing shear edges in a cutting direction to cause said contact points to progress toward said apices, while progressively causing relative movement between said first and second shear edges in a second direction opposite said first direction to bring said first and second apices into coincidence whereby said contact points converge at said apices.

17. Method as claimed in claim 16 wherein the difference of said convergence angles is between 0° 10' and 1° 0".

18. Method as claimed in claim 16 wherein the difference in said convergence angle is about 0° 30".

19. Method as claimed in claim 16 including the step of supporting said outwardly facing shear edges for limited relative lateral movement from side to side relative to said inwardly facing shear edges and for tilting relative to said inwardly facing shear edges during said progressive movement.

* * * * *